United States Patent [19]

Bevington

[11] 3,952,987

[45] Apr. 27, 1976

[54] CHAIR ADJUSTMENT CONSTRUCTION

[75] Inventor: Kenneth A. Bevington, Evanston, Ill.

[73] Assignee: Bevco Precision Manufacturing Company, Evanston, Ill.

[22] Filed: Oct. 24, 1974

[21] Appl. No.: 517,467

[52] U.S. Cl. ..... 248/408; 248/188.5

[51] Int. Cl.[2] ..... F16M 11/16; A47C 3/34

[58] Field of Search ..... 248/408, 407, 409, 423, 248/188.5, 354 P; 403/107, 108

[56] References Cited

UNITED STATES PATENTS

| | | | |
|---|---|---|---|
| 1,007,322 | 10/1911 | Barnes | 248/188.5 |
| 1,725,312 | 8/1929 | Stoll | 248/408 X |
| 2,019,753 | 11/1935 | Wittel | 248/188.5 |
| 2,122,868 | 7/1938 | Morgan | 248/408 X |
| 2,382,291 | 8/1945 | Carlberg | 403/107 |
| 2,542,480 | 2/1951 | Cramer et al. | 248/408 |

FOREIGN PATENTS OR APPLICATIONS

| | | | |
|---|---|---|---|
| 902,779 | 1/1954 | Germany | 248/408 |
| 451,122 | 7/1936 | United Kingdom | 248/408 |
| 565,820 | 11/1944 | United Kingdom | 248/408 |

*Primary Examiner*—J. Franklin Foss
*Attorney, Agent, or Firm*—Allegretti, Newitt, Witcoff & McAndrews

[57] ABSTRACT

A chair construction of the type including a base with an upstanding supporting tube and a seat with a depending tube telescopically fitted within the upstanding tube, includes an improved height adjustment mechanism for the seat. A manually operated handle or trigger on the upstanding tube has an inclined planar tab that fits into any one of a plurality of slots defined in the depending tube to provide desired seat elevation. The tubes have a hexagonal cross section with complementary wedge surfaces so that the depending tube is guided by the planar tab into wedging engagement with the upstanding tube.

9 Claims, 5 Drawing Figures

CHAIR ADJUSTMENT CONSTRUCTION

BACKGROUND OF THE INVENTION

This invention relates to an improved chair construction, and more particularly, to an adjustment mechanism for adjusting the elevation of a chair seat.

U.S. Pat. No. 3,285,555 issued Nov. 15, 1966 to Kenneth A. Bevington for a Chair Construction discloses a chair which includes a leg or support section and a seat section. These sections interconnect by means of telescoping tubes. The height or elevation of the seat of the chair construction can be adjusted by movement of the telescoping tubes relative to each other. Insertion of a locking member in one of a plurality of openings in one of the tubes and compression from a locking clamp member about the tubes maintains the seat at the desired elevation.

This particular construction works extremely well and is commercially successful. However, the construction requires manipulation of a clamping mechanism before adjustment of the elevation of the seat. As a result, an alternative construction was designed and was the subject matter of a patent application, Ser. No. 646,615 filed June 16, 1967, now abandoned. This abandoned application discloses a pair of telescoping tubes cooperative with a lever handle or trigger attached to the outside tube to engage slots defined in the inside tube. This particular construction, though workable, tended to produce a loose, unsatisfactory fit between the telescoping tubes. In other words, the tubes were not rigid relative to each other even though ease of adjustment of the tubes was improved.

The present invention provides a structure which eliminates the problems associated with the prior art by improving the ease of seat height adjustment and promoting tight fit between the telescopically connected support tubes.

SUMMARY OF THE INVENTION

In a principal aspect of the present invention, comprises a chair construction having a base with an upstanding supporting tube and a seat with a depending guide tube telescopically fitted within the upstanding tube. A handle or trigger mechanism is attached to the upstanding base tube. A plurality of slots or openings are defined along the outside longitudinal axis of the depending seat tube. The trigger mechanism includes a downwardly inclined planar member which is normally biased to fit within one of the openings or slots and guide the depending post member in the direction of the incline. This causes complementary wedging surfaces defined in the tube members to be engaged tightly and prevent undesired rotation of the telescoped tubes.

It is thus an object of the present invention to provide an improved chair construction.

It is a further object of the present invention to provide a chair construction including telescoped, interfitted tubes having engaging wedging surfaces and a mechanism for causing those surfaces to fit tightly with each other.

One further object of the present invention is to provide an improved chair construction having an easily workable height adjustment.

Still another object of the present invention is to provide an improved seat adjustment for a chair construction with fewer parts and a simple construction relative to the prior art.

These and other objects, advantages and features of the present invention will be set forth in greater detail in the description which follows.

BRIEF DESCRIPTION OF THE DRAWING

In the detailed description which follows, reference will be made to the drawing comprised of the following figures.

DESCRIPTION OF THE PREFERRED EMBODIMENT

Figure 2:
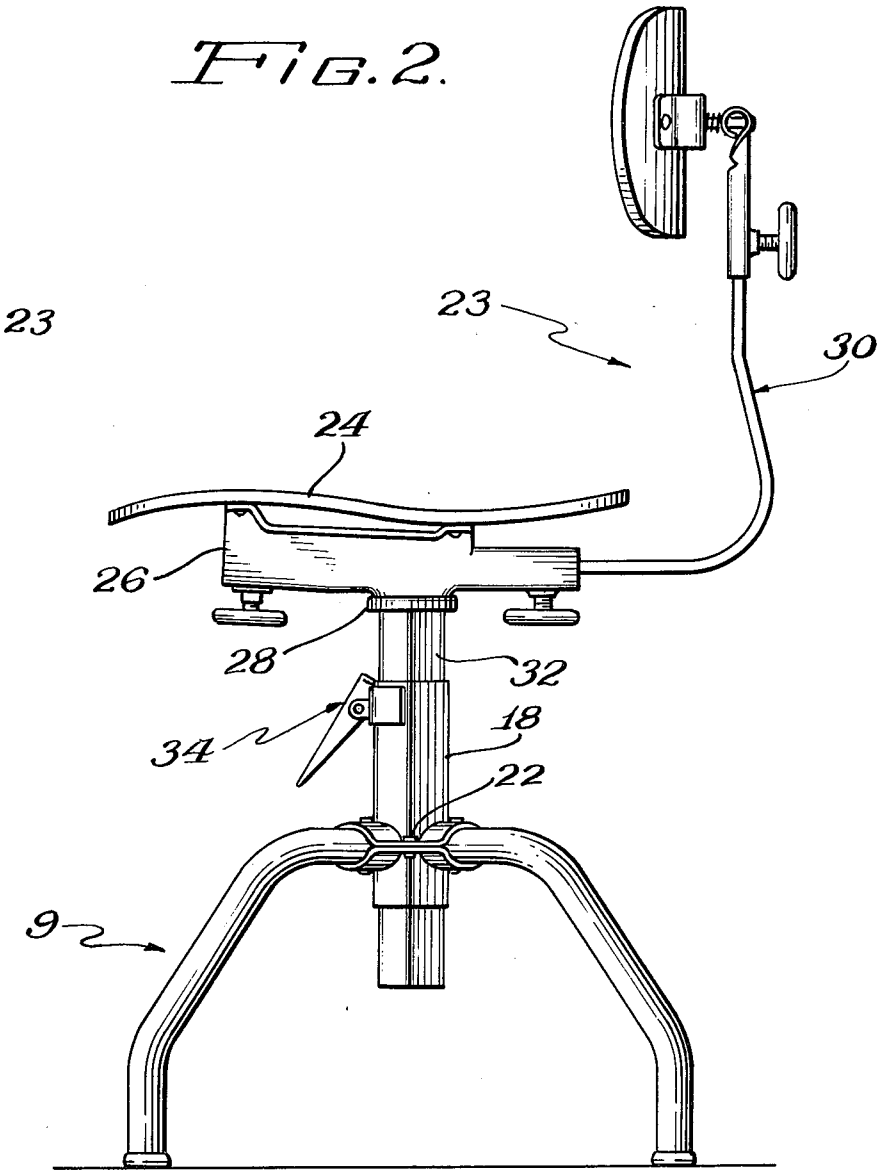
FIG. 2 is a side elevation view of the chair construction disclosed in FIG. 1.
Figure 1:
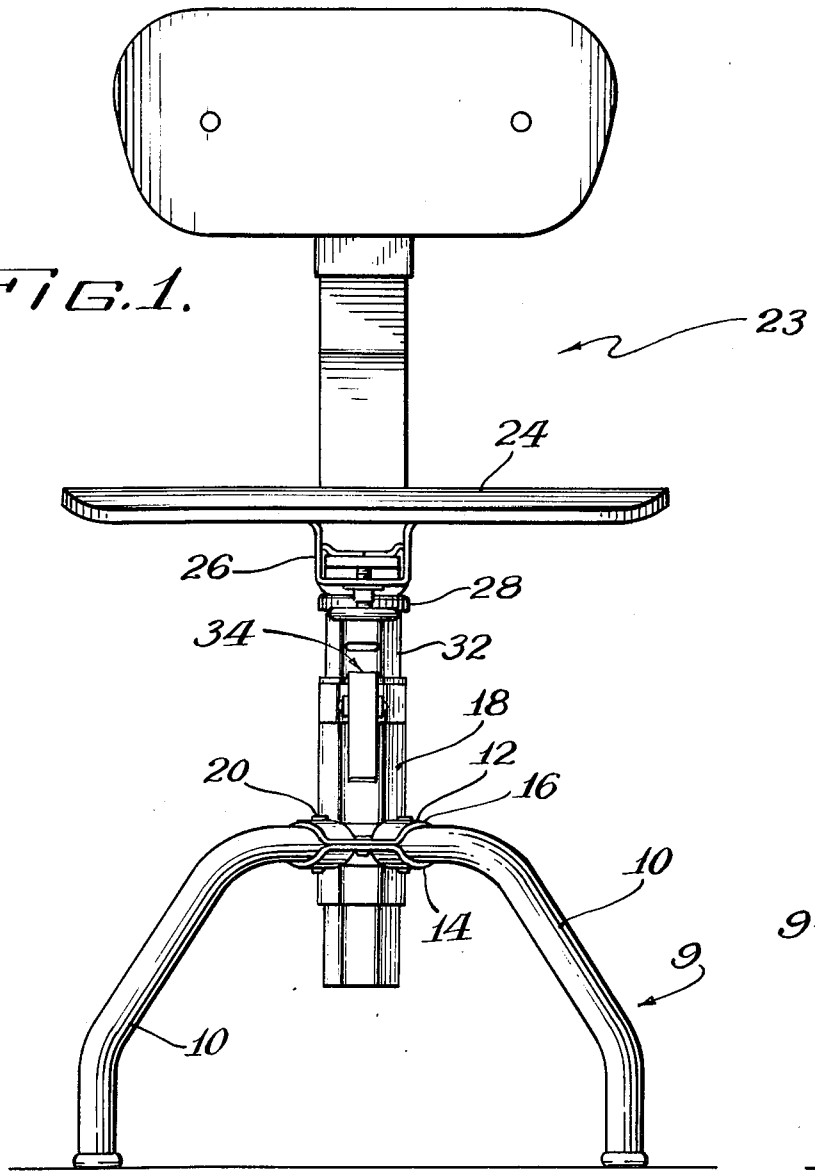
FIG. 1 is a front elevation view of a chair construction incorporating the improved seat adjustment mechanism of the present invention.

Referring first to FIGS. 1 and 2, the improved adjustment mechanism for a chair construction is illustrated as being incorporated in a typical seat and support arrangement. In the embodiment described, the particular seat and support illustrated is not to be considered as a limiting feature of the invention.

Referring to the figures, the chair construction includes a support 9 having a plurality of tubular legs 10 secured at their upper ends to a hub 12. The hub 12 is formed from opposing flange members 14 and 16 which are welded or brazed to an upstanding, longitudinal outside support tube 18. The legs 10 are fastened, for example, by rivets or pins 20, to the hub 12. Additionally, rivets 22 are utilized to hold the flange members 14 and 16 together to compress the legs 10 in a locked relationship with the hub 12.

Cooperating with the base structure 9 is a seat assembly 23 including a seat 24 which may be formed of any suitable material such as wood, metal or plastic. A bracket 26 is secured to the underside of the seat 24 by rivets or other fastening means. The bracket 26 illustrated in the figures includes various adjustment mechanisms cooperative with a swivel 28 and an upstanding seat back assembly 30.

Depending from the bracket 26 and attached thereto is a tube 32. The tube 32 has a cross-sectional shape similar to the cross-sectional shape of outside tube 18 and is telescopically fitted within outside tube 18. A handle assembly or trigger 34 mounted on the outside of tube 18 cooperates with tube 32 in a manner to be described below to maintain the seat 24 in a fixed elevation relative to the base support 9. Additionally, the handle mechanism 34 provides a means for adjusting the elevation of the seat 24.

Figure 3:
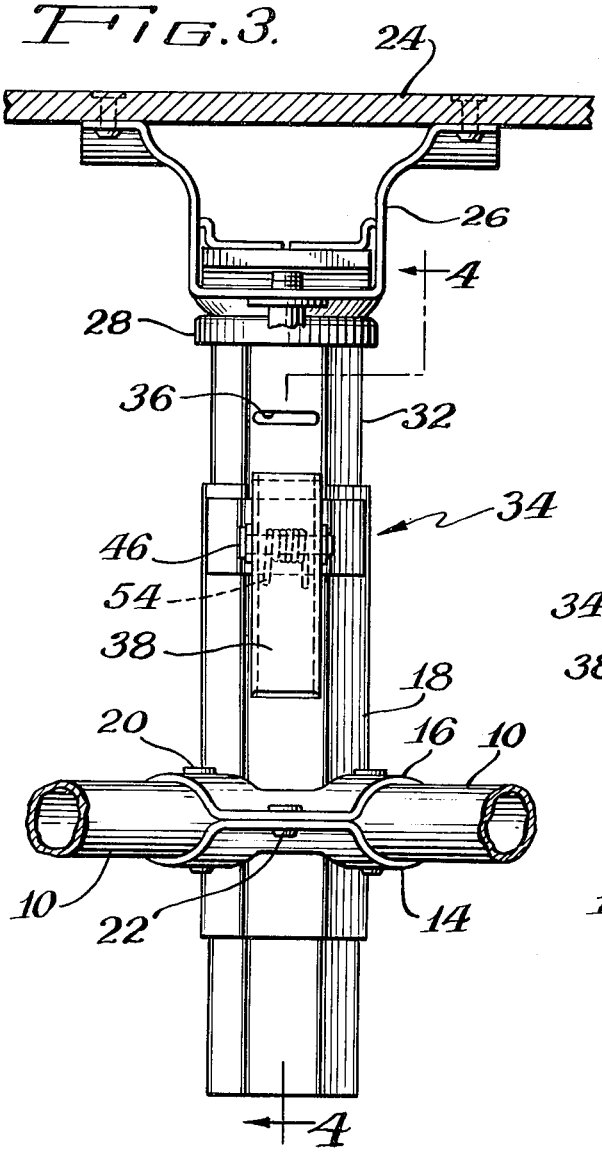
FIG. 3 is an enlarged, partial front elevation of the improved adjustment mechanism of the present invention.
Figure 4:
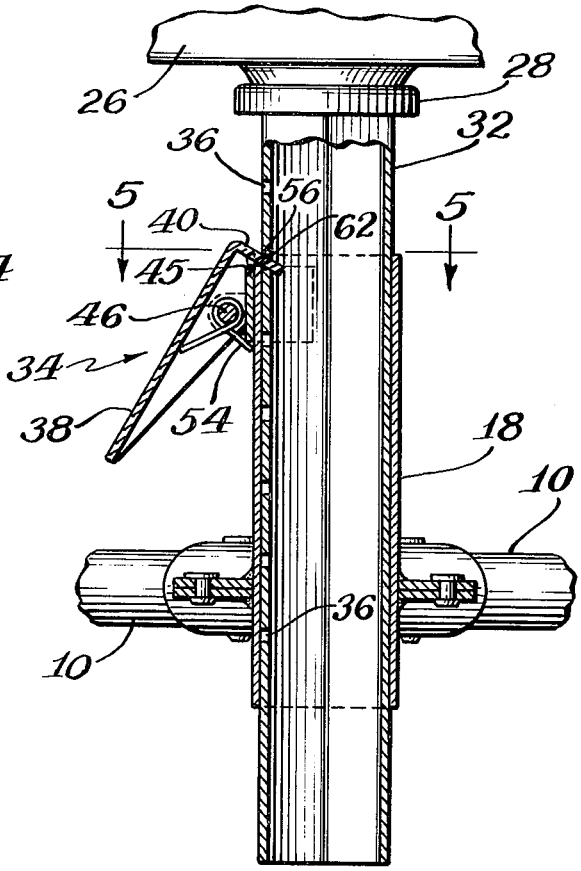
FIG. 4 is a side cross-sectional view of the adjustment mechanism taken along the line 4—4 in FIG. 3.
Figure 5:
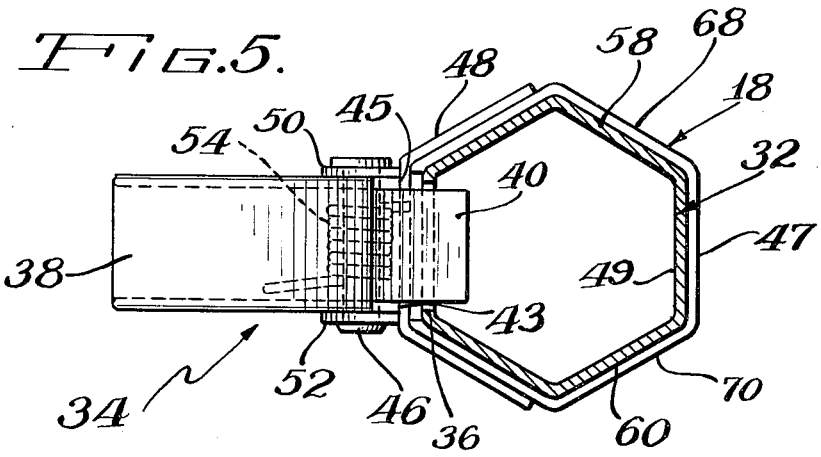
FIG. 5 is a top cross-sectional view of the adjustment mechanism of the invention taken along the line 5—5 of FIG. 4.

Referring to FIGS. 3 through 5, the inside tube 32 and the outside tube 18 are shown as having a hexagonal cross section. The inside tube 32 includes a plurality of spaced slots 36. The slots 36 are arranged vertically, one above the other, transverse to the longitudinal axis of the tube 32. The slots 36 are equispaced and define the distance of each increment of height adjustment associated with the chair construction. It is to be noted that the inside tube 32 need not be tightly fitted within the outside tube 18. Some looseness in their relative sizing may be observed since the construction of the present invention accounts for slack in the fit of the telescoped tubes 18 and 32.

The handle mechanism or trigger 34 is attached to the outside tube 18 and is comprised of a manually operable lever arm 38 with an integrally attached inclined planar tab 40. Depending side flanges 42 and 44 extend from the lever arm 38 and include opposed openings for receipt of a mounting pin 46. Pin 46 is mounted on tube 18 by means of a strap 48 and attached, projecting supports 50 and 52. A biasing spring 54 is wrapped around pin 46 and engages the handle 38 driving the handle in a clockwise direction as seen in FIG. 4. The depending side flanges 42 and 44 define stop surfaces 43 and 45, respectively, which limit the travel of trigger 34. In this manner, the tab 40 is biased to a predetermined, fixed position of downward inclination relative to the tubes 18 and 32.

The downward inclination of tab 40 is an important feature of the invention since the tube 32 and, in particular, the top surface 56 of a slot 36 engages the tab 40 and tends to slide down the tab 40 in the direction of the downward inclination thereof. The tendency of tube 32 to "slide down" the tab 40 permits the tube 32 to be guided not only in a downward direction relative to tube 18, but also in a direction away from the handle assembly 34 and toward opposite side wall 47 of the tube 18. As a result, wedging surfaces 58 and 60 of tube 32 cooperate and engage complementary wedging surfaces 68 and 70 respectively of outside tube 18. The surfaces 58 and 60 thus act as wedge surfaces in combination with surfaces 68 and 70 to take up any slack in the relative fit between the tubes 18 and 32.

To accentuate the wedging action, the planar surface or wall 49 of tube 32 opposed to surface or wall 47, may be foreshortened or moved toward the center of tube 32. The surfaces 58 and 68 and 60 and 70 would thus be wedged against each other without being limited by the interference of walls 47 and 49.

The cooperative action of the slot 36 with the tab 40 insures that the tube 32 is "driven" in the proper direction to accentuate the wedging action since the acute angle formed by the planes of surfaces 58 and 60 includes the tab 40. Preferably, the direction of movement imparted by tab 40 to tube 32 bisects the acute angle defined by the planes of surfaces 58 and 60.

As another feature of the invention, the lower surface of the tab 40 is preferably designed to engage upper edge 62 of the tube 18 when the handle assembly 34 is biased to the chair locking position shown in FIG. 4. The stop surfaces 43 and 45 define the chair locking position. In this manner, possible strains on the pin 46 resulting from the weight on seat assembly 23 are relieved, and the forces imparted by the weight of the seat assembly 23 are directed to the upper surface 56 of slot 36 as well as the upper edge 62 of tube 18.

To operate the chair adjustment construction, the lever arm 38 is manually operated against the biasing force of spring 54. This removes tab 40 from a slot 36 and permits longitudinal sliding of tube 32 relative to tube 18. Another slot 36 may then be positioned for cooperation with tab 40. The lever arm 38 is released and the tab 40 then engages the newly positioned slot 36. The handle mechanism 34 thus has an engaged, chair locking or operative position and a disengaged or inoperative position depending upon the position of the lever arm 38.

Although the wedging surfaces 58, 68, 60 and 70 have been defined in terms of tubes 18 and 32 having hexagonal cross sections, it is possible to utilize tubes having various other cross sections. For example, the tubular construction could be triangular. Slots 36 would then be provided in the side of the tube defining the base of the triangular cross section. The other sides of the triangular cross section would define the wedging surfaces. The cross-sectional shape of the surfaces associated with the tubes could also be curved. Numerous other shapes are also possible to establish the cooperative relationship desired between the inclined tab 40, the slot 36 and wedging surfaces.

Thus, while there has been set forth a preferred embodiment of the present invention, it is to be understood that various modifications and changes can be made within the scope of the following claims. The invention is, therefore, to be limited only by the following claims and their equivalents.

What is claimed is:

1. In a chair construction of the type including a base having an upstanding supporting tube, and a seat with a depending guide tube connected at its upper end to said seat, said depending tube being telescopically fitted within said upstanding tube, the improvement comprising an elevation adjustment mechanism for the telescoped tubes;

said mechanism including a plurality of verically spaced openings, each opening defining a substantially horizontal planar bearing surface in said depending tube;

a lever arm attached to one side of said upstanding tube, said lever arm including a downwardly inclined member having a planar surface for engaging the bearing surface through a chosen one of said openings;

means for normally biasing said lever member downwardly into said one opening; and said tubes including at least a pair of engaging, complementary, wedge surfaces generally opposite said lever arm, whereby the depending tube wedge surface is directed by said inclined member into frictional wedge locking engagement with the upstanding member wedge surface while simultaneously retaining said opening in alignment for engagement by said lever arm.

2. The improved chair construction of claim 1 wherein said lever arm includes a handle connected to the downwardly depending member, said handle being manually engageable to transport said downwardly depending member into and out of engagement with said openings.

3. The improved chair construction of claim 1 wherein said openings comprise slots transverse to the longitudinal axis of said tubes and wherein said downwardly inclined member comprises a planar tab for engaging said slots.

4. The improved chair construction of claim 1 wherein said tubes have the same cross sectional shape and each tube includes at least two surfaces parallel to the longitudinal axis thereof joined together to define an included acute angle.

5. The improved chair construction of claim 4 wherein said tubes have a hexagonal cross section.

6. The improved chair construction of claim 4 wherein said angle includes said downwardly inclined member.

7. The improved chair construction of claim 1 wherein said downwardly inclined member has a locking position and a release position, said member engaging the top edge of said tube and simultaneously engaging the top of one opening when in the locking position.

8. The improved chair construction of claim 1 including stop means on said lever arm to limit the biased travel of said lever arm.

9. The improved chair construction of claim 1 wherein said lever arm projects over the top edge of the upstanding tube and into said tube.

* * * * *